313-414 SR

4/7/87 OR 4,656,391

United States Patent [19]

Say

[11] Patent Number: 4,656,391

[45] **Date of Patent: * Apr. 7, 1987**

[54] COLOR CATHODE RAY TUBE IN-LINE ELECTRON GUN FOCUSING ELECTRODE WITH OVERLAPPING TAPERED APERTURES ENLARGED FOR BEAM SPOT SHAPING, AND GUN STRUCTURES INCORPORATING SAME

[75] Inventor: Donald L. Say, Waterloo, N.Y.

[73] Assignee: North American Philips Consumer Electronics Corp., New York, N.Y.

[ * ] Notice: The portion of the term of this patent subsequent to Sep. 17, 2002 has been disclaimed.

[21] Appl. No.: 681,039

[22] Filed: Dec. 12, 1984

[51] Int. Cl.[4] ..... H01J 29/62

[52] U.S. Cl. ..... 313/414

[58] Field of Search ..... 313/414, 412, 413, 458, 313/460

[56] References Cited

U.S. PATENT DOCUMENTS

| | | | |
|---|---|---|---|
| 4,517,488 | 5/1985 | Say | 313/414 |
| 4,535,266 | 8/1985 | Say | 313/414 |
| 4,542,318 | 9/1985 | Say | 313/414 |

*Primary Examiner*—David K. Moore
*Assistant Examiner*—K. Wieder
*Attorney, Agent, or Firm*—John C. Fox

[57] ABSTRACT

In a color cathode ray tube having an in-line electron gun with overlapping CFF lenses, the small openings of the focusing electrode apertures are critically enlarged to balance the asymmetry of the lensing field caused by the overlap, and beam spot distortion due to field asymmetries in the focus region is eliminated. Enlargement is achieved by elongating the openings in a direction normal to the in-line plane, and widening the outer openings.

21 Claims, 7 Drawing Figures

COLOR CATHODE RAY TUBE IN-LINE ELECTRON GUN FOCUSING ELECTRODE WITH OVERLAPPING TAPERED APERTURES ENLARGED FOR BEAM SPOT SHAPING, AND GUN STRUCTURES INCORPORATING SAME

CROSS-REFERENCE TO RELATED APPLICATIONS

The following U.S. patents and patent applications relate to color cathode ray tube electrodes having tapered apertures: U.S. Pat. No. 4,542,318 a continuation-in-part of Ser. No. 450,574, filed Dec. 16, 1982, now abandoned; U.S. Pat. No. 4,517,488; U.S. Pat. No. 4,535,266; and Ser. No. 680,713, filed concurrently herewith.

Ser. No. 487,347, filed Apr. 21, 1983, describes and claims color cathode ray tube electrodes having enlarged apertures.

The above applications are assigned to the assignee of the present invention.

BACKGROUND OF THE INVENTION

This invention relates to a focusing electrode for an inline electron gun structure for color cathode ray tubes (CCRT's), in which the apertures are tapered and overlapping; and more particularly relates to such electrode in which the small openings of the apertures are enlarged for electron beam spot-shaping; and also relates to gun structures incorporating such electrode.

Reducing the diameter of the necks of CCRT's can lead to cost savings for the television set maker and user in enabling a corresponding reduction in the size of the beam deflection yokes, leading to cost savings in both material and power consumption. However, reducing neck diameter while maintaining or even increasing display screen area severely taxes the performance limits of the electron gun.

In the conventional in-line electron gun design, an electron optical system is formed by applying critically determined voltages to each of a series of spatially positioned apertured electrodes. Each electrode has at least one planar apertured surface oriented normal to the tube's long or Z axis, and containing three side-by-side or "in-line" circular straight-through apertures. The apertures of adjacent electrodes are aligned to allow passage of the three (red, blue and green) electron beams through the gun.

Most such guns are based on a bipotential lens design, in which focusing is achieved in a lensing field provided by two or more electrodes divided into a low voltage portion and a high voltage portion, typically a low voltage focusing electrode ($G_3$) and a high voltage accelerating electrode ($G_4$). The lensing field is formed in the region of beam acceleration, i.e., inside the forward portion of the focusing electrode, in the gap between the forward aperture plane of the focusing electrode and the rearward aperture plane of the accelerating electrode, and inside the rearward portion of the accelerating electrode.

As the gun is made smaller to fit into the so-called "minineck" tube, the apertures are also made smaller and as is well known, the focusing or lensing abberrations of the focusing and accelerating electrode apertures are increased, thus degrading the quality of the resultant picture on the display screen.

Various design approaches have been taken to attempt to increase the effective aperture sizes of these lensing electrodes. For example, U.S. Pat. No. 4,275,332, and U.S. patent application Ser. No. 303,751, filed Sept. 21, 1981, describe overlapping lens structures. U.S. patent application Ser. No. 487,347, filed Apr. 21, 1983, describes a lens structure with enlarged apertures surrounded by a raised rim. U.S. patent application Ser. No. 463,791, filed Feb. 4, 1983, describes a "conical field focus" or CFF lens arrangement. Each of these designs is intended to increase effective aperture size in the main lensing electrodes and thus to maintain or even improve gun performance in the new "minineck" tubes.

In the CFF arrangement, a large effective aperture size in the focusing and accelerating electrodes is provided by apertures having the shapes of truncated cones or hemispheres. That is, each aperture has a large opening in the aperture plane and a related small opening in the electrode interior. The large openings of both the focusing and accelerating electrodes thus face each other across the gap.

In a preferred CFF embodiment, the effective aperture size of both electrodes is further increased by enlarging the apertures until their large openings overlap. This overlapping eliminates portions of the sidewalls between adjacent apertures, leaving arcuate "saddles" bridging these apertures across the in-line plane.

These saddles create asymmetric lenses having larger diameters in the direction of the in-line plane than in the transverse direction. In the focusing electrode, such asymmetry tends to create beam spots at the screen with severe horizontal elongation. Thus, for optimum performance of the overlapping CFF lens arrangement, the asymmetry in the focusing electrode must be fully compensated, such as by an effectively identical or "balancing" asymmetry in the accelerating electrode.

Such an identical or "balancing" asymmetry in the accelerating electrode cannot be achieved simply by creating identical facing saddles in this electrode, because, due to the potential difference across the gap, the beams have a higher velocity in, and their parths are less affected by the accelerating electrode than the focusing electrode.

Thus, in practice, the accelerating electrode apertures in the CFF gun are even further enlarged to deepen the saddles sufficiently to create a compensating asymmetry for the asymmetry of the focusing electrode. See concurrently filed U.S. patent application, Ser. No. 680,713.

In some new gun designs now being considered, identical parts are used for both the focusing and accelerating electrodes to minimize astigmatism caused by noncircularity of the apertures. See co-pending U.S. patent application Ser. No. 516,028, filed July 22, 1983, and assigned to U.S. Philips Corp. Of course, the use of such identical parts in the CFF lensing arrangement prevents the opportunity for balancing of the horizontal asymmetry due to the saddles in the focusing electrode.

It is an object of the present invention to provide a focusing electrode with overlapping tapered apertures which has a vertical asymmetry sufficient to substantially compensate for the horizontal asymmetry of the saddles. Such an electrode is referred to herein as a "self-balancing" electrode.

It is a further object of the present invention to provide a modified bipotential lens electron gun structure incorporating a self-balancing focusing electrode, which modified structure will enable the use of identical parts for both the focusing and accelerating electrodes, without significant distortion of the beam spots at the screen.

SUMMARY OF THE INVENTION

In accordance with the invention, a focusing electrode of an in-line electron gun for a CCRT, featuring partially overlapping tapered apertures with large outer openings and smaller related inner openings, is modified by enlarging the inner openings in a critical way to create a vertical asymmetry sufficient to substantially compensate for the horizontal asymmetry in the lensing field caused by the saddles between adjacent apertures.

The electrode apertures are of a three-dimensional surface of revolution (hereinafter called a volumetric configuration), which is substantially truncated, for example, a truncated cone or hemisphere, the axes of symmetry of which are substantially parallel to one another and to the associated path of the electron beam. Each aperture thus has a large generally circular opening in an outer aperture plane of the electrode and a smaller related opening in the interior of the electrode, being separated from the outer opening by sloping sidewalls. A portion of the sidewall of each aperture intersects a portion of the sidewall of an adjacent aperture to form an inwardly-sloping arcuate rounded saddle along the region of the intersection. The resulting structure is derived from the partial overlapping of geometric constructions of the volumetric configurations.

In order to compensate for the lensing field asymmetry caused by the use of overlapping lenses for the focusing electrode, the smaller openings of the apertures are enlarged to provide a balancing asymmetry. Specifically, the smaller openings are elongated in the vertical direction (normal to the in-line plane). In addition, the smaller openings of the outer apertures are also enlarged outwardly in the horizontal direction.

As used herein, the term "elongated" generally means the form resulting from expansion of a circle along a radius (oblong), but also includes forms resulting from such expansion accompanied by some distortion of the circular curvature (e.g., ellipse).

In a preferred embodiment, the central aperture is oblong-shaped, and the two side apertures are D-shaped.

As used herein, the term "D-shaped" means the form resulting from rounding the corners of a "D".

Such a self-balancing focusing electrode is particularly useful in a bipotential lensing arrangement, in which the forward portion of the focusing electrode and the rear portion of the accelerating electrode are placed in adjacent, facing relationship, in which each defines three partially overlapping, tapered, inline apertures, a central aperture and two side apertures. In a preferred embodiment the same electrode structure is employed for both the focusing and accelerating electrode of such lensing arrangement.

DESCRIPTION OF THE PREFERRED EMBODIMENTS

Figure 1:
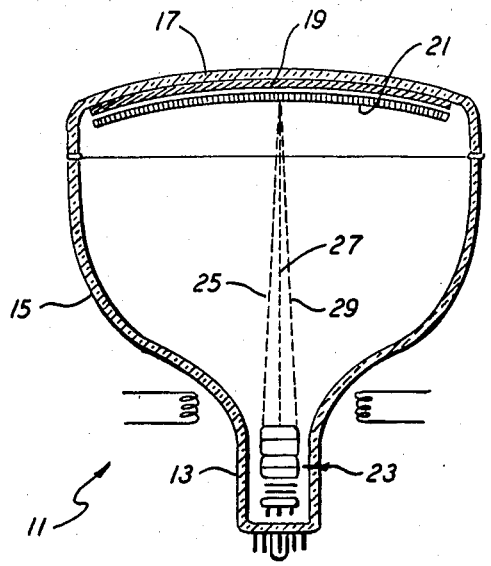
FIG. 1 is a sectioned elevation view of a color cathode ray tube wherein the invention is employed.

With reference to FIG. 1 of the drawings, there is shown a color cathode ray tube (CCRT) of the type employing a plural beam in-line electron gun assembly. The envelope enclosure is comprised of an integration of neck 13, funnel 15 and face panel 17 portions. Disposed on the interior surface of the face panel is a patterned cathodoluminescent screen 19 formed as a repetitive array of color-emitting phosphor components in keeping with the state of the art. A multi-opening structure 21, such as a shadow mask, is positioned within the face panel, spaced from the patterned screen.

Encompassed within the envelope neck portion 13 is a unitized plural beam in-line electron gun assembly 23, comprised of a unitized structure of three side-by-side guns. Emanating therefrom are three separate electron beams 25, 27, and 29 which are directed to pass through mask 21 and land upon screen 19. It is within this electron gun assembly 23 that the structure of the invention resides.

Figure 2:
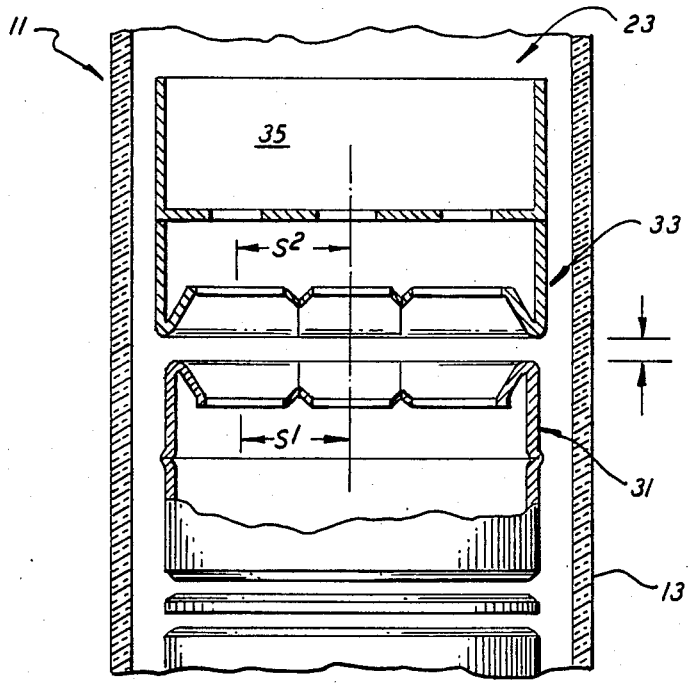
FIG. 2 Prior Art
FIG. 2 is a sectioned view of the forward portion of the in-line plural beam electron gun assembly shown in FIG. 1, showing a bipotential lens arrangement of the prior art.

Referring now to FIG. 2, the forward portion of the electron gun 23 of FIG. 1 is shown illustrating a bipotential lensing arrangement of the prior art, including a low potential electrode 31, a high potential electrode 33, and a convergence cup 35. Electrode 31 is the final focusing electrode of the gun structure, and electrode 33 is the final accelerating electrode. Together, these two electrodes form the final lensing fields for the electron beams. This is accomplished by cooperation between their adjacent, facing apertured portions to form lensing regions which extend across the inter-electrode space and into the adjacent regions of the focusing and accelerating electrodes. The tapered sidewalls of the apertures enable optimum utilization of the available space inside the tube neck 13. As is known, a slight offset of the outer apertures of the accelerating electrode (33) ($S^2$ greater than $S^1$) results in convergence of the three beams at the screen.

In a "Uni-Bi" gun (sometimes called Quadrapotential Focus, or QPF) typically used in mini-neck CCRT's, the main focusing electrode potential is typically 25 to 35 percent of the final accelerating electrode potential, the inter-electrode spacing is typically about 0.040 inches (1.02 millimeters), the angle of taper of the apertures is about 30° with respect to the tube axis, and the aperture diameters (smaller and larger dimensioned openings) are 0.140 and 0.220 inches (3.56 and 5.59 millimeters) for the focusing electrode and 0.150 and 0.250 inches (3.81 and 6.35 millimeters) for the accelerating electrode. The spacing between aperture centers is 0.177 inch (4.50 millimeter) ($S^1$) for the focusing electrode and 0.182 inch (4.62 millimeter) ($S^2$) for the accelerating electrode.

While the CFF lensing arrangement referred to above was developed primarily to improve the performance of mini-neck (22 mm) tubes, its advantages are, of course, also realized in tubes having other neck sizes, such as the standard narrow-neck (29 mm).

In a "HiBi" gun (high bipotential focus) typically used in narrow-neck CCRT's, the main focusing electrode potential is typically 25 to 35 percent of the final accelerating electrode potential, the inter-electrode spacing is typically about 0.040 inches (1.02 millimeters), the angle of taper of the apertures is about 30° with respect to the tube axis, and the aperture diameters (smaller and larger dimensioned openings) are 0.216 inches, and 0.280 inches (5.49 and 7.11 millimeters) for the focusing electrode and 0.230 and 0.294 inches (5.84 and 7.47 millimeters) for the accelerating electrode. The spacing between aperture centers is 0.260 inch (6.60 millimeter) ($S^1$) for the focusing electrode and 0.267 inch (6.78 millimeter) ($S^2$) for the accelerating electrode.

Figure 3:
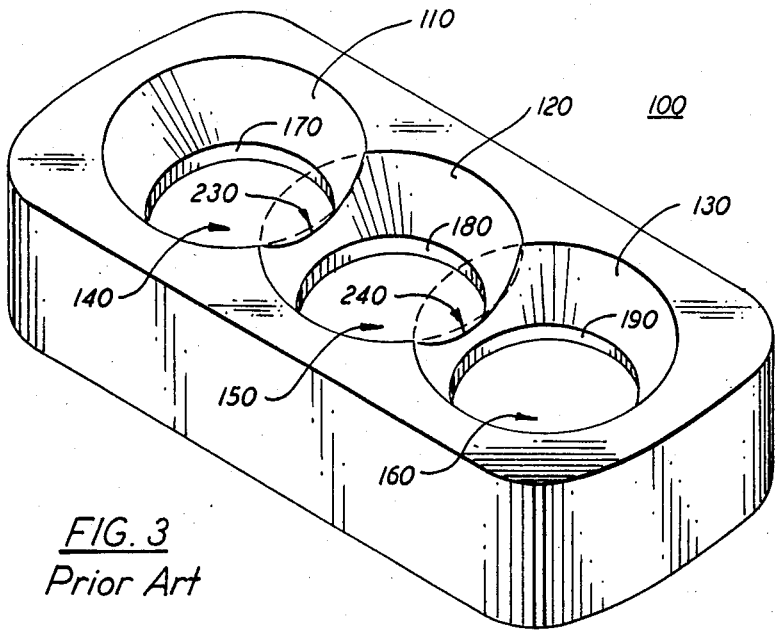
FIG. 3 Prior Art
FIG. 3 is a perspective view from above of the unitized low potential lensing electrode of the gun assembly of FIG. 2, affording a partial view of the small openings of the apertures.

Referring now to FIG. 3, there is shown a focusing electrode 100 of the type shown in FIG. 2, having three in-line apertures with large front beam-exiting openings 110, 120 and 130 substantially in the forward planar surface of the electrode, and smaller rear beam-entering openings 140, 150 and 160 in the interior of the electrode, such openings connected by substantially tapered sidewalls terminating with relatively short cylindrical portions in phanthom in the forward planar surface, and results in the partial removal of sidewall portions of adjacent apertures and the formation of inwardly sloping arcuate edges 230 and 240, termed herein "saddles", resulting in reduced sidewall area between apertures, horizontal asymmetry of the lensing field, and electron beam spots at the screen compressed vertically and elongated horizontally (in the direction of the in-line plane.)

Because of this asymmetry in the focusing electrode, it has been found necessary to make the tapered apertures of the accelerating electrode substantially larger than those of the focusing electrode, so that the saddles of the accelerating electrode are as much as 15% deeper than those of the focusing electrode. With the deeper saddles, the asymmetry of the accelerating electrode then exactly compensates for the asymmetry of the focusing electrode. See concurrently filed U.S. patent application Ser. No. 608,713.

Figure 4:
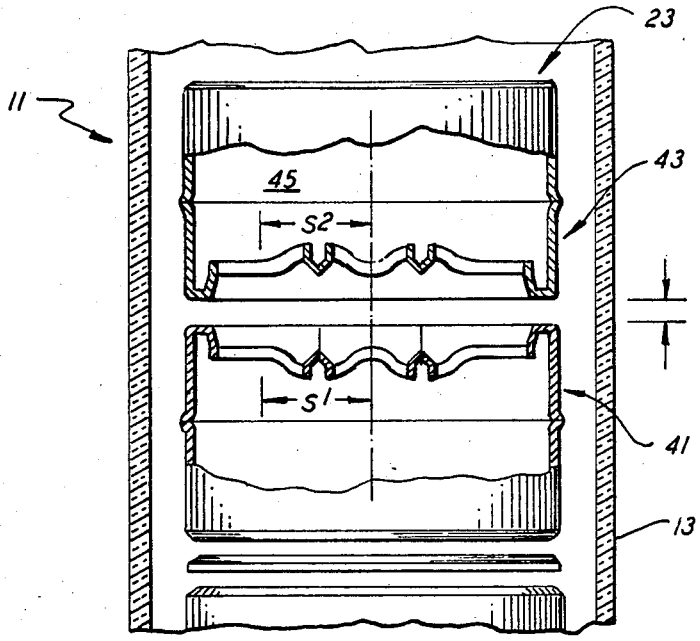
FIG. 4 is a sectioned view similar to that of FIG. 2, showing the bipotential lens arrangement employing the invention.

Referring now to FIG. 4, there is shown a section view similar to that of FIG. 2, showing a preferred bipotential lensing arrangement of the invention in which identical parts are used for electrodes 41 and 43. While the offset between outer apertures has thus been eliminated, ($S^1=S^2$), as is known in the art convergence of the three beams at the screen can be provided by other means, such as by modification of other gun components, or by modification of the magnetic deflection field, or by placement of internal or external magnets. However, due to the previously mentioned higher electron beam velocity in the accelerating electrode with identical parts, the asymmetries of electrode 43 no longer cancel those of electrode 41. In accordance with the invention, a vertical asymmetry can be introduced into electrodes 41 and 43 by careful and critical enlargement of the small openings of the apertures of the electrodes, resulting in such electrodes being self-balancing, and enabling the use of identical parts for the focusing and accelerating electrode.

Figure 5:
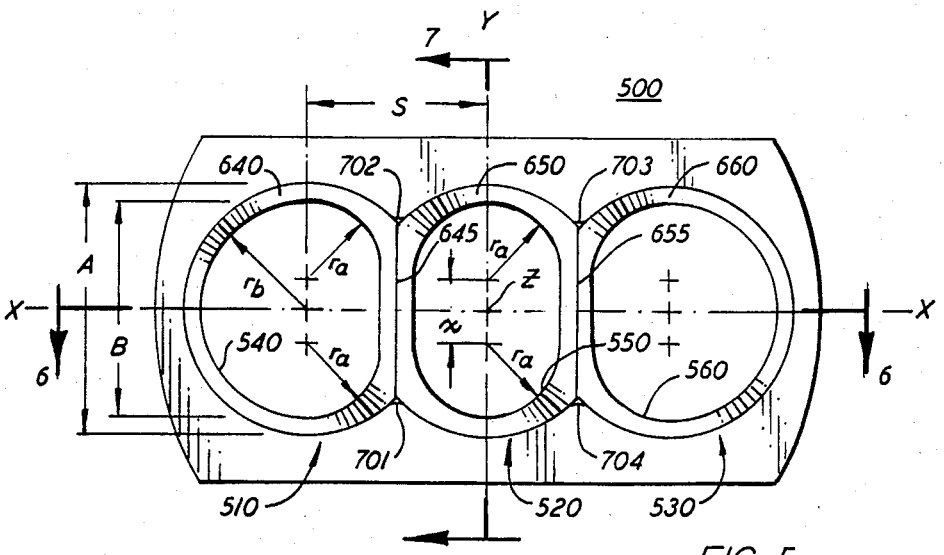
FIG. 5 is a top view of one embodiment of a unitized lensing electrode of the invention including enlarged rear openings of the apertures.
Figure 6:
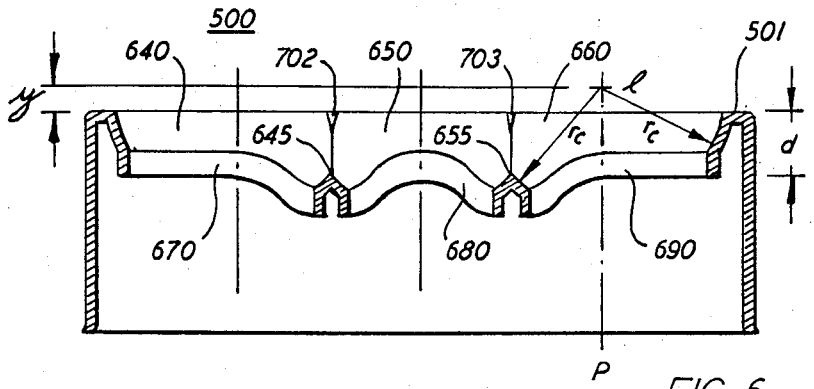
FIG. 6 is a sectioned elevation view of the embodiment of the electrode of FIG. 5 taken along the plane 6—6 in FIG. 5.
Figure 7:
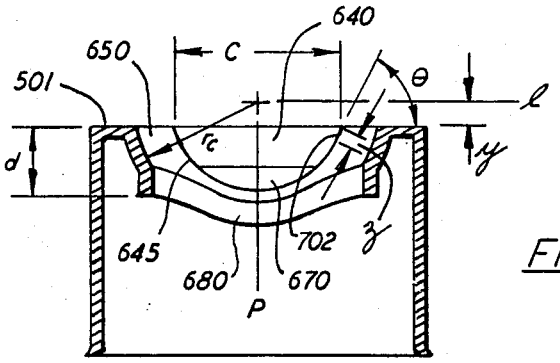
FIG. 7 is a sectioned view of the embodiment of FIG. 5 taken along the plane 7—7 of FIG. 5.

One embodiment of such critical enlargement is shown in FIGS. 5, 6, and 7. FIG. 5 is a top view of electrode 500, which can be either the focusing or accelerating electrode of the gun. In this embodiment, aperture 520 has small opening 550 in the shape of an elongated circle of radius $r_a$, elongated by the distance x along the diameter normal to the tube's Z axis. Opening 540 of aperture 510 can be described as having a right side and a left side, separated by an axis parallel to the elongating radius of opening 550. The right side is in the same shape as the right or left half of opening 550, being generated by the elonfation of a semi-circle of radius $r_a$ by a distance x. The left side of opening 540 is a semi-circle of radius $r_b$, equal to $r_a$ plus $\frac{1}{2}$ x. Opening 560 of aperture 530 is in the shape of a mirror image of opening 540. The center of each aperture lies on the tube's X axis, while the center of the aperture 520 also lies at the intersection of the tube's X, Y and Z axes. The centers of apertures 510 and 530 are closer to the inside edge of the aperture than to the outside edge at the X axis. The aperture centers lie in the approximate centers of the electron beam paths.

Aperture size has thus been increased by vertical elongation of the small openings of the center and side apertures, and by horizontal enlargement of the small openings of the side apertures. The asymmetry caused by such modifications to the prior art structure balances the asymmetry caused by the saddle regions so that both focusing and accelerating electrodes impart symmetrical focusing to the electron beam, and the differing velocities in the two regions no longer cause spot distortion when identical parts are used.

Referring now to FIG. 6, a section view along plane 6—6 of FIG. 5, it is seen that in this embodiment the tapered sidewalls 640, 650 and 660 of apertures 510, 520 and 530 are generally spherical, having a radius $r_c$, extending from the point of intersection of beam path P with construction line l. Straight sidewall portions 670, 680 and 690 extend inward from the tapered portions to terminate in the interior of electrode 500.

Referring now to FIG. 7, a section view along plane 7—7 of FIG. 5, it is seen that saddle 645 has a length C and a depth d, the depth d preferably being approximately equal to the vertical elongation x of the small openings. (within ±20%). Within such range, it has been found that the vertical field asymmetry resulting from such elongation substantially cancels the horizontal asymmetry caused by the presence of the saddles.

As is seen in FIG. 6, line l is raised above the top surface 501 of the electrode 500 by height y, although the value of y may be zero or even a negative value. In general, as y becomes positive, the depth of the saddle d lessens and both the needed amount of vertical elongation x lessens, and effective aperture size lessens.

In another preferred embodiment, the saddles terminate in small planar shoulders 701, 702, 703 and 704. In FIG. 7, the shoulders 701 and 702 extend tangentially from the top of the saddle 645 at an angle $\theta$ with the top surface 501 of electrode 500, and have a length z. These shoulders tend to soften the otherwise sharp, angular contour resulting from the intersection of the large openings with the forward aperture plane. Such softening could also be achieved with curved shoulders blending into the saddle arc and the top surface of the part. Such softening has been found to have a favorable effect on the roundness of overfocused spots.

An example of the above-described embodiment is presented for a narrow-neck (29 mm neck OD) gun assembly. The main focusing electrode potential is substantially 25 to 35 percent of the final accelerating electrode potential. The interelectrode spacing is about 0.040". Electrode dimensions are substantially as follows:

| Main Focusing Electrode (41) and Final Accelerating Electrode (43) | Dimensions In The Order of: |
|---|---|
| Beam Spacings (S) center-to-center | 0.236 inch |
| Dia. (A) of Apertures (510,520,530) | 0.317 inch |
| Dia. (B) of Small Openings (540,550,560) | 0.276 inch |
| Radius ($r_a$) | 0.098 inch |
| Radius ($r_b$) | 0.138 inch |
| Elongation (x) | 0.080 inch |
| Radius ($r_c$) | 0.161 inch |
| Height (y) | 0.030 inch |
| Length (c) | 0.217 inch |
| Depth (d) | 0.079 inch |
| Length (z) | 0.025 inch |
| Angle ($\theta$) | 30° |

It is to be understood that the foregoing exemplary dimensions are provided only as an aid to understanding the invention, and are not to be considered limiting.

Use of the described structure in either or both the low potential electrode and the high potential electrode which generate the final lensing field provides substantially round beam spot landings at the screen.

While there have been shown and described what are at present considered to be the preferred embodiment of the invention, it will be obvious to those skilled in the art that various changes and modifications may be made therein without departing from the scope of the invention as defined in the appended claims.

What is claimed is:

1. A low potential lensing structure for an in-line electron gun structure for a color cathode ray tube comprising:

an electrode, having three in-line tapered apertures of substantially truncated volumetric configuration having substantially parallel axes of symmetry, each aperture having beam-exiting front and smaller dimensioned beam-entering rear openings, the front openings lying in a forward aperture plane and being generally circular and the front and rear openings separated by sloping sidewalls, a portion of the sidewall of each aperture intersecting with a portion of the sidewall of an adjacent aperture to form an inwardly sloping arcuate wall along the region of intersection; the axes of symmetry of said apertures in said electrode lying substantially in the in-line plane;

characterized in that the smaller openings of the apertures are enlarged, whereby the lensing field asymmetry caused by such enlargement substantially balances the lensing field asymmetry caused by the arcuate walls.

2. The lensing structure of claim 1 wherein the smaller openings are elongated in a direction normal to the in-line plane.

3. The lensing structure of claim 2 wherein the smaller openings of the outer apertures are enlarged in the direction of the in-line plane.

4. The lensing structure of claim 2 wherein the elongation of the smaller apertures is from about 0.8 to 1.2 times the distance from the aperture plane to the bottom of the associated arcuate walls.

5. The lensing structure of claim 3 wherein the smaller central openings are oblong-shaped.

6. The lensing structure of claim 3 wherein the smaller outer openings are D-shaped.

7. The lensing structure of claim 1 wherein the arcuate walls terminate in shoulders.

8. The lensing structure of claim 7 wherein the shoulders are planar and tangential to the arcuate edges of the walls.

9. The lensing structure of claim 8 wherein the shoulder tangent lines form an angle of from about 40° to 80° with the aperture plane.

10. The lensing structure of claim 7 wherein the shoulders are curved to blend the arcuate edge to the aperture plane.

11. In an in-line electron gun structure for a color cathode ray tube having an in-line plane, a lensing arrangement in the final focusing and accelerating electrodes comprising:

a first lensing structure in the forward portion of the focusing electrode, such structure having three in-line tapered apertures of substantially truncated volumetric configuration having substantially parallel axes of symmetry, each aperture having beam-exiting front and smaller dimensioned beam-entering rear openings, the front openings laying in a forward aperture plane and being generally circular and the front and rear openings separated by sloping sidewalls, a portion of the sidewall of each aperture intersecting with a portion of the sidewall of an adjacent aperture to form an inwardly sloping arcuate wall along the region of intersection; and a second lensing structure in the rear portion of the final accelerating electrode in adjacent, facing relationship with the first structure, such second structure having three in-line tapered apertures of substantially truncated volumetric configuration having substantially parallel axes of symmetry, each aperture having beam-entering rear and smaller dimensioned beam-exiting front openings, the rear openings lying in a rearward aperture plane and being generally circular and the front and rear openings separated by sloping sidewalls, a portion of the sidewall of each aperture intersecting with a portion of the sidewall of an adjacent aperture to form an inwardly sloping arcuate wall along the region of intersection;

the axes of symmetry of said apertures in said first and second lensing structures lying substantially in the in-line plane, and the space $S_1$, between the axes of symmetry of the center and outer apertures of the first lensing structure is approximately equal to the space $S_2$ between the axes of symmetry of the center and outer apertures of the second lensing structure;

characterized in that the smaller openings of the apertures of at least the first lensing structure are enlarged, whereby the lensing field asymmetry caused by such enlargement substantially balances the lensing field asymmetry caused by the arcuate walls.

12. The lensing arrangement of claim 11 wherein the enlarged smaller openings are elongated in a direction normal to the inline plane.

13. The lensing arrangement of claim 12 wherein the smaller openings of the outer apertures are enlarged in the direction of the in-line plane.

14. The lensing arrangement of claim 12 wherein the elongation of the smaller apertures is from about 0.8 to 1.2 times the distance from the aperture plane to the bottom of the associated arcuate walls.

15. The lensing arrangement of claim 13 wherein the smaller central openings are oblong-shaped.

16. The lensing arrangement of claim 13 wherein the smaller outer openings are D-shaped.

17. The lensing arrangement of claim 11 wherein the arcuate walls terminate in shoulders.

18. The lensing arrangement of claim 17 wherein the shoulders are planar and tangential to the arcuate edges of the walls.

19. The lensing arrangement of claim 18 wherein the shoulder tangent lines form an angle of from about 40° to 80° with the aperture plane.

20. The lensing arrangement of claim 17 wherein the shoulders are curved to blend the arcuate edge to the aperture plane.

21. The lensing arrangement of claim 11 in which the first and second lensing electrodes are substantially identical.

* * * * *